US010306719B2

(12) United States Patent
Wiegand

(10) Patent No.: US 10,306,719 B2
(45) Date of Patent: May 28, 2019

(54) INDICATING DEVICE WITH COMPENSATING CONFIGURATION

(71) Applicants: DENSO International America, Inc., Southfield, MI (US); DENSO CORPORATION, Kariya, Aichi-pref. (JP)

(72) Inventor: Michael Wiegand, Birmingham, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 417 days.

(21) Appl. No.: 15/007,562

(22) Filed: Jan. 27, 2016

(65) Prior Publication Data

US 2017/0215242 A1 Jul. 27, 2017

(51) Int. Cl.
*H05B 33/08* (2006.01)

(52) U.S. Cl.
CPC ..... *H05B 33/0827* (2013.01); *H05B 33/0857* (2013.01)

(58) Field of Classification Search
CPC ..... H05B 33/0827; H05B 33/0857; H05B 33/0884
See application file for complete search history.

(56) References Cited

U.S. PATENT DOCUMENTS

2010/0117538 A1* 5/2010 Fujino ..... H02M 3/33507 315/77
2010/0157583 A1* 6/2010 Nakajima ..... H01L 25/0753 362/184
2011/0115407 A1* 5/2011 Wibben ..... H05B 33/0815 315/294

FOREIGN PATENT DOCUMENTS

JP 2005063687 * 3/2005
JP 2008-193807 A 8/2008
JP 2008193807 * 8/2008
JP 2013178106 * 9/2013

* cited by examiner

*Primary Examiner* — Joseph R Haley

(57) ABSTRACT

A first LED is connected to a power line to emit a first light in a first color toward a screen when applied with a power-line voltage of the power line. A second LED is connected to the power line to emit a second light in a second color toward the screen when applied with the power-line voltage. The first color is complementary to the second color.

13 Claims, 13 Drawing Sheets

INDICATING DEVICE WITH COMPENSATING CONFIGURATION

TECHNICAL FIELD

The present disclosure relates to an indicating device with a compensating configuration.

BACKGROUND

Conventionally, an indicating device may employ an illuminating device such as a light emitting diode (LED) energized by an electric source. An illuminating device may generally have an intensity characteristic such as a color characteristic. When variation occurs in a power-line voltage of an electric source, an illuminating device may cause color shift and/or variation in intensity of light correspondingly to the variation.

SUMMARY

According to an aspect of the preset disclosure, a first LED may be connected to a power line and may be configured to emit a first light in a first color toward the screen when applied with a power-line voltage of the power line. A second LED may be connected to the power line and may be configured to emit a second light in a second color toward the screen when applied with the power-line voltage. The first color may be complementary to the second color.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

As follows, a first embodiment of the present disclosure will be described with reference to drawings. In the description, a vertical direction is along an arrow represented by "VERTICAL" in drawing(s). A lateral direction is along an arrow represented by "LATERAL" in drawing(s).

Figure 1:
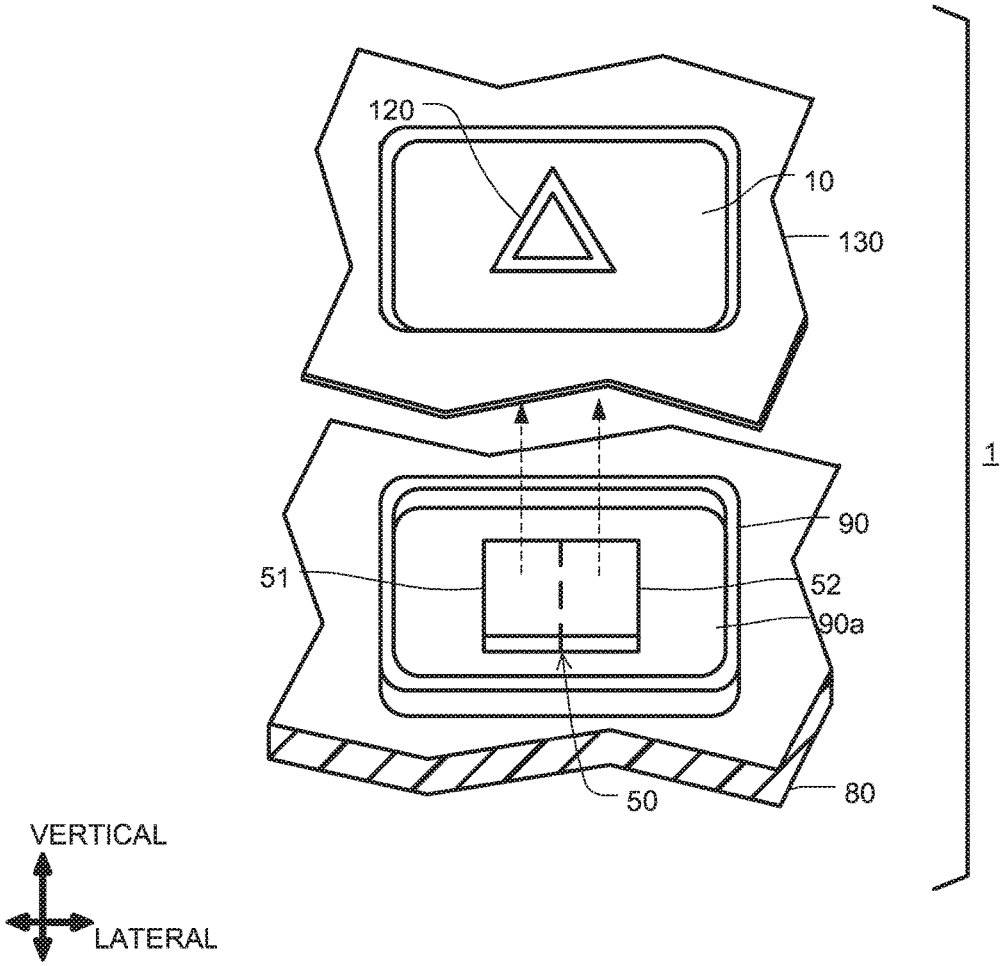
FIG. 1 is a perspective view showing an indicating device of a first embodiment.
Figure 2:
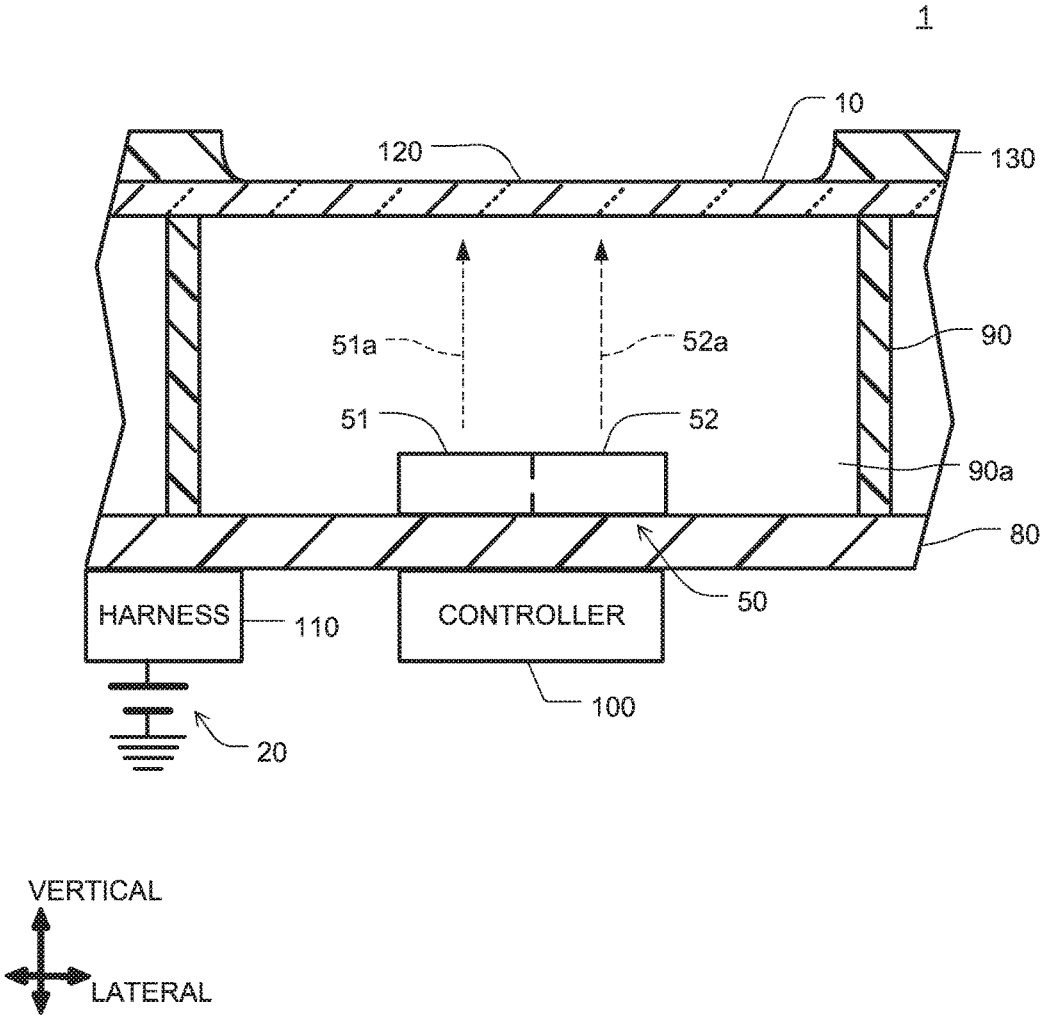
FIG. 2 is a sectional view showing the indicating device.

As shown in FIGS. 1 and 2, in the example, an indicating device 1 may be an instrument lamp equipped in a console of a vehicle. The indicating device 1 may illuminate a symbol 120 when energized. The indicating device 1 may include a screen 10, a light emitting diode (LED) device 50, and a printed circuit board (PCB) 80.

The screen 10 may be a flat sheet formed of a non-opaque material such as PMMA resin or polycarbonate. The screen 10 may have the symbol 120. The symbol 120 may be printed on a surface of the screen 10. The screen 10 may be covered with a bezel 130. The bezel 130 may be formed of an opaque material such as ABS resin. The bezel 130 may be a part of the console.

The LED device 50 may emit light when being supplied with electricity. The LED device 50 may include a first LED 51 and a second LED 52, which are integrated into one piece on a singular substrate and may be configured to emit lights individually.

In FIG. 2, the PCB 80 may be equipped with various components such as the LED device 50, a controller 100, a harness 110, a resistor 61 (FIG. 2, described later), a switch 71 (described later), and/or the like. The components may be soldered on electric wirings printed on the PCB 80. The PCB 80 may be equipped with a partition 90 surrounding the LED device 50. The partition 90 may be formed of an opaque material such as ABS resin to form a rectangular inner space 90*a* and to surround the LED device 50.

The screen 10 may be coupled with the PCB 80. Specifically, the PCB 80 may be mounted to a console of a vehicle such that the LED device 50 is opposed to the screen 10. The partition 90 may isolate the inner space 90*a* from exterior of the partition 90 thereby not to leak light to the exterior.

The controller 100 may be a microcomputer including a CPU, a storage device such as a RAM and a ROM, and a bus interconnecting the CPU with the storage device.

The harness 110 may be coupled with a power source 20 via a power wiring. The power source 20 may be a DC battery of a vehicle to supply a direct current. The battery may employ various forms such as a lithium ion battery, a lead battery, a capacitor, and/or the like. The battery may be connected with other various components such as a HVAC apparatus, a power train apparatus, and/or electric and electronic devices. The battery may be further connected with another power source such as an alternator, a motor generator, and/or the line.

The harness 110 may conduct electricity supplied from the power source 20 to components such as the LED device 50 and the controller 100. The controller 100 may be equipped with a power regular to stabilize a voltage applied to the controller 100. The controller 100 may be further equipped with an I/O device coupled with other components.

Figure 3:
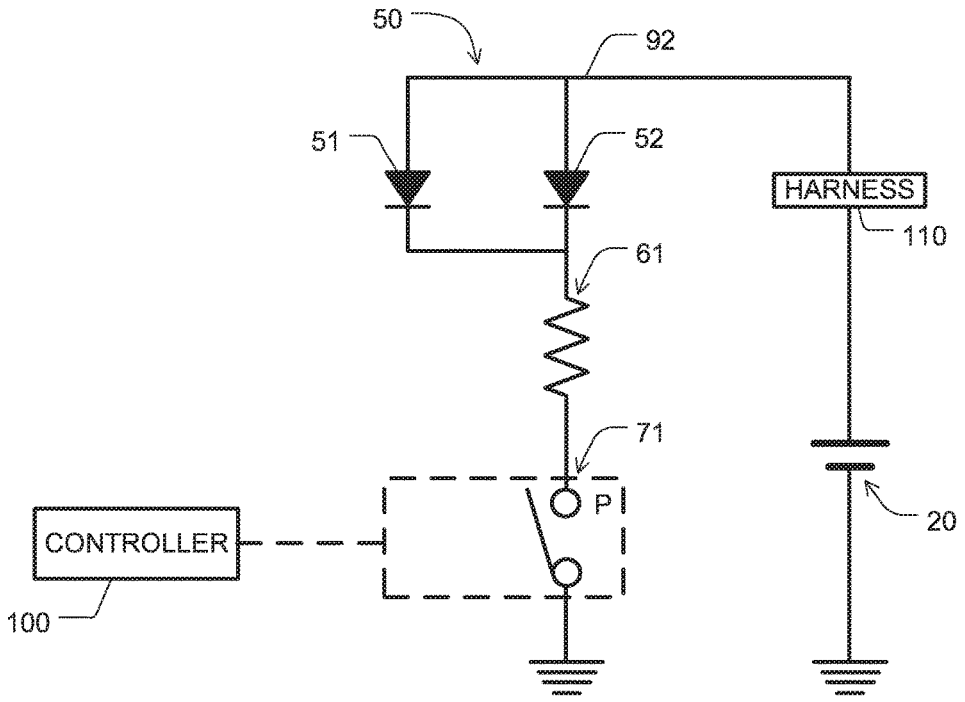
FIG. 3 is a diagram showing a circuit of the indicating device.

As shown in FIG. 3, the first LED 51 and the second LED 52 may be connected in parallel with each other. The first LED 51 and the second LED 52 may be connected with the resistor 61 and the switch 71 in series. The first LED 51 and the second LED 52 may be connected with the power source 20 on the positive side through a power line 92 and the power wiring. The switch 71 may be connected with the ground on the negative side. The switch 71 may be coupled with the controller 100 such that the controller 100 controls activation and deactivation (ON/OFF) of the switch 71.

The resistor 61 may be, for example, a semiconductor-chip resistor. The switch 71 may be a solid state relay (SSR) including a bipolar transistor and/or a MOS-FET. The controller 100 may control the switch 71 by controlling application of voltage on a gate of the switch 71 when the switch 71 is a MOS-FET. Alternatively, the controller 100 may control the switch 71 by controlling electricity supplied to a base of the switch 71 when the switch 71 is a bipolar transistor.

When the switch 71 is activated (turned ON), both the first LED 51 and the second LED 52 may be applied with a voltage by the power source 20. Thus, the first LED 51 and the second LED 52 may conduct electricity therethough to emit light toward the screen 10 (FIG. 2). When the switch 71 is de-activated (turned OFF), both the first LED 51 and the second LED 52 may be deactivated to terminate the emission of the light.

In the following description, it may be assumed that both the first LED 51 and the second LED 52 have the same current-voltage characteristic. That is, both the first LED 51 and the second LED 52 may conduct the same electric current when applied with the same voltage. In the present example, the first LED 51 and the second LED 52 may conduct electricity of 1 mA when applied with 3 V, may conduct electricity of 5 mA when applied with 6 V, may conduct electricity of 10 mA when applied with 10V, and may conduct electricity of 30 mA when applied with 16 V.

In FIG. 2, the first LED 51 may emit a first light 51*a* in a first color toward the screen 10 when being energized. The first LED 51 may have a first color characteristic relative to increase in the power-line voltage. Specifically, the first LED 51 may increase intensity of a red component in the emitted color by increasing the power-line voltage. The second LED 52 may emit a second light 52*a* in a second color toward the screen 10 when being energized. The second LED 52 may have a second color characteristic relative to increase in the power-line voltage. Specifically, the first LED 51 may increase intensity of a blue component in the emitted color by increasing the power-line voltage. The first light 51*a* emitted from the first LED 51 and the second light 52*a* emitted from the second LED 52 may be mixed together and directed toward the screen 10. Thus, the mixed light may illuminate the symbol 120 of the screen 10.

In actual operation of the indicating device 1, the power-line voltage of the power source 20 may vary due to, for example, unbalanced demand of electric power from various components, excessive power recovery from a motor generator, aging of the power source 20, and/or the like. When the power-line voltage of the power source 20 changes, the power-line voltage applied to the LED device 50 may change correspondingly.

Figure 4:
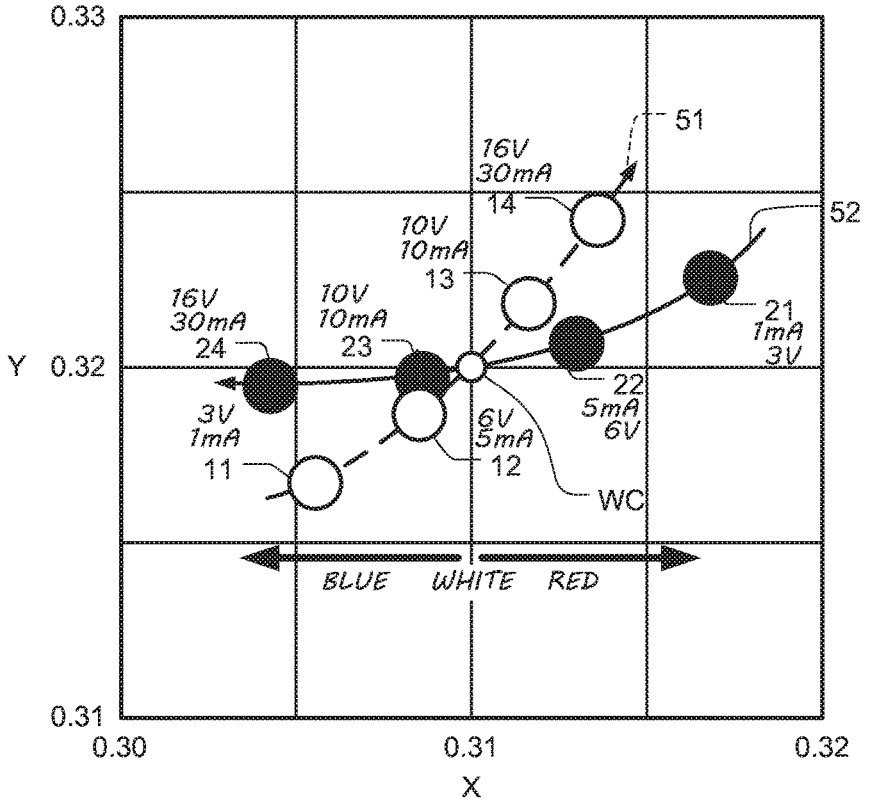
FIGS. 4 to 6 are graphs showing a color characteristic of the indicating device.

FIG. 4 shows a CIE chromaticity diagram representing the first color characteristic of the first LED 51 and the second color characteristic of the second LED 52. In the CIE chromaticity diagram, the center coordinates represents a white center WC, which corresponds to a white component. As the coordinates move leftward in the CIE chromaticity diagram, the light may increase intensity of a blue component thereby to become blueish. To the contrary, as the coordinates move rightward in the CIE chromaticity diagram, the light may increase intensity of a red component thereby to become reddish.

Blank circles 11, 12, 13, and 14 represent the first color characteristic. The circles 11, 12, 13, and 14 may respectively correspond to an electric current of 1 mA, 5 mA, 10 mA, and 30 mA supplied to the first LED 51. As the power-line voltage increases, and as the electric current increases, the coordinates of the first color may move rightward in the diagram along the dotted arrow 51 through the white center WC. Specifically, when the electric current supplied to the first LED 51 is 1 mA at the circle 11, the first light 51*a* from the first LED 51 may have high intensity of the blue component and may be relatively bluish. When the electric current of the first LED 51 increases to 5 mA at the circle 12, the first color may reduce its blue component to become relatively whitish. As the electric current of the first LED 51 further increases to 10 mA at the circle 13, the first color may increase its red component to become relatively reddish. As the electric current of the first LED 51 further increases to 30 mA at the circle 14, the first color may further increase its red component to become further reddish. That is, as the electricity of the first LED 51 increases, the first color being bluish may change to whitish around the white center WC, and subsequently, the first color being whitish may change to reddish. Conversely, as the electricity decreases, the first color being reddish may return to bluish.

Solid circles 21, 22, 23, and 24 represent the second color characteristic. The circles 21, 22, 23, and 24 may respectively correspond to an electric current of 1 mA, 5 mA, 10 mA, and 30 mA supplied to the second LED 52. As the electric current increases, the coordinates of the second color may move leftward in the diagram along the solid arrow 52 through the white center WC. Specifically, when the electric current supplied to the second LED 52 is 1 mA at the circle 21, the second light 52*a* from the second LED 52 may have high intensity of the red component and may be relatively reddish. As the electric current of the second LED 52 increases to 5 mA at the circle 22, the second color may reduce its red component to become relatively whitish. As the electric current of the second LED 52 further increases to 10 mA at the circle 23, the second color may increase its blue component to become relatively blueish. As the electric current of the second LED 52 further increases to 30 mA at the circle 24, the second color may further increase its blue component to become further blueish. That is, as the electricity of the second LED 52 increases, the second color being reddish may change to whitish around the white center WC, and subsequently, the second color being whitish may change to blueish. Conversely, as the electricity decreases, the second color being blueish may return to reddish.

As described above, the first color characteristic and the second color characteristic may be opposite to each other with respect to increase in electricity and decrease in electricity. The wording of the opposite may encompass a substantially or approximately opposite relationship. The first color characteristic and the second color characteristic may be opposite to each other when the coordinate of the first color and the coordinates of the second color move in different directions in the X axis in the chromaticity diagram with increase or decrease in the power-line voltage.

Figure 5:
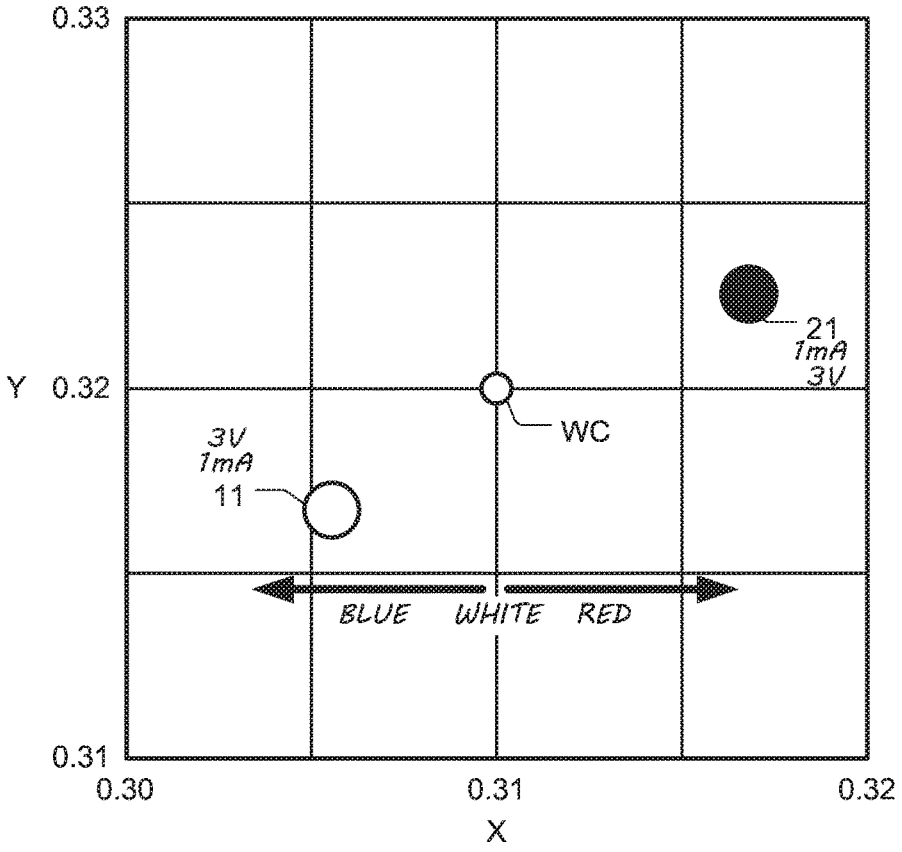

FIG. 5 shows the color characteristics of the first LED 51 and the second LED 52 when both the first LED 51 and the second LED 52 are supplied with electricity of 1 mA. In FIG. 5, the circle 11, which represents the bluish first light 51*a* from the first LED 51, and the circle 21, which represents the reddish second light 52*a* from the second LED 52, are at opposite positions across the white center WC. That is, the bluish first light 51*a* and the reddish second light 52*a* may be in complementary colors in the chromaticity diagram to cancel each other. Therefore, the bluish first light 51*a* and the reddish second light 52*a* may compensate each other to be ultimately mixed together to form a whitish mixed light.

Figure 6:
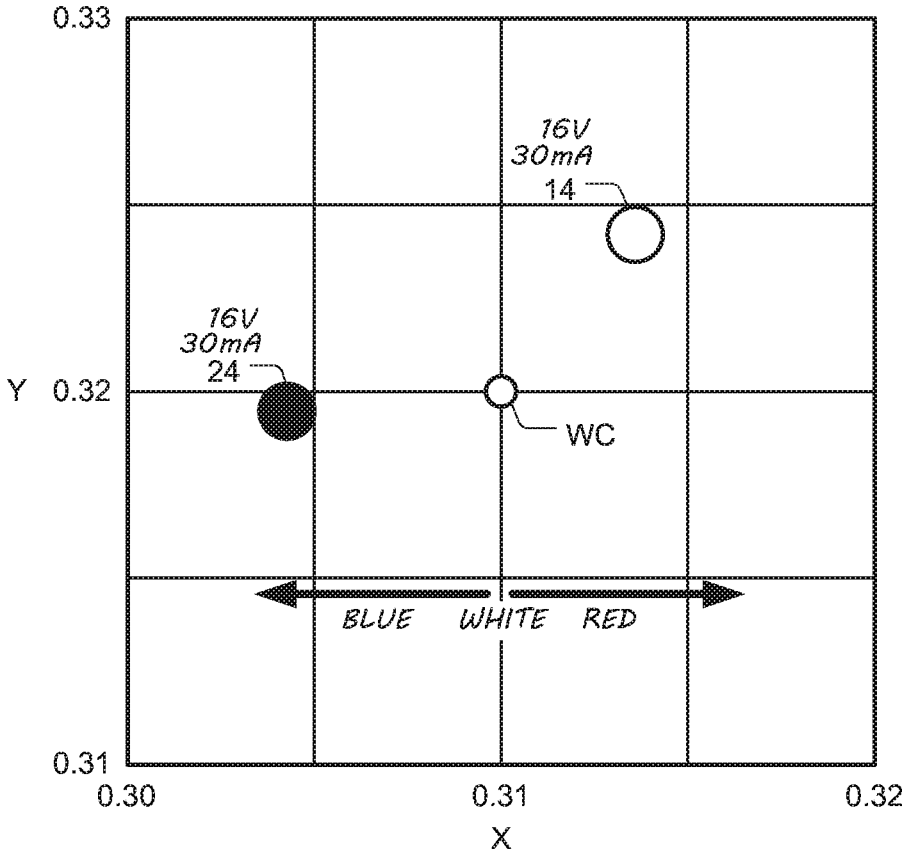

FIG. 6 shows the color characteristics of the first LED 51 and the second LED 52 when both the first LED 51 and the second LED 52 are supplied with electricity of 30 mA. In FIG. 6, the circle 14, which represents the reddish first light 51*a* from the first LED 51, and the circle 24, which represents the bluish second light 52*a* from the second LED 52, are at opposite positions across the white center WC. That is, the reddish first light 51*a* and the bluish second light 52*a* may be in complementary colors to cancel each other. Therefore, the bluish first light 51*a* and the reddish second light 52*a* may compensate each other to be ultimately mixed together into whitish mixed light.

In FIG. 4, in a case where both the first LED 51 and the second LED 52 are supplied with electricity of 5 mA, the circle 12, which represents the first light 51*a* from the first LED 51, and the circle 22, which represents the second light 52*a* from the second LED 52, are at opposite positions across the white center WC. In a case where both the first LED 51 and the second LED 52 are supplied with electricity of 10 mA, the circle 13, which represents the first light 51*a* from the first LED 51, and the circle 23, which represents the second light 52*a* from the second LED 52, are at opposite positions across the white center WC. Therefore, in either case, the first light 51*a* and the second light 52*a* may be in complementary colors to cancel each other.

As described above, the first color characteristic of the first LED 51 may be opposite to the second color characteristic of the second LED 52 relative to increase in the power-line voltage and relative to decrease in electricity supply. Therefore, when being applied with the same voltage and when being supplied with the same electricity, both the first LED 51 and the second LED 52 may emit the first light 51*a* and the second light 52*a*, respectively, in complementary colors. Therefore, the first light 51*a* and the second light 52*a* may offset color shift each other as the voltage application from the power source 20 varies.

Second Embodiment

Figure 7:
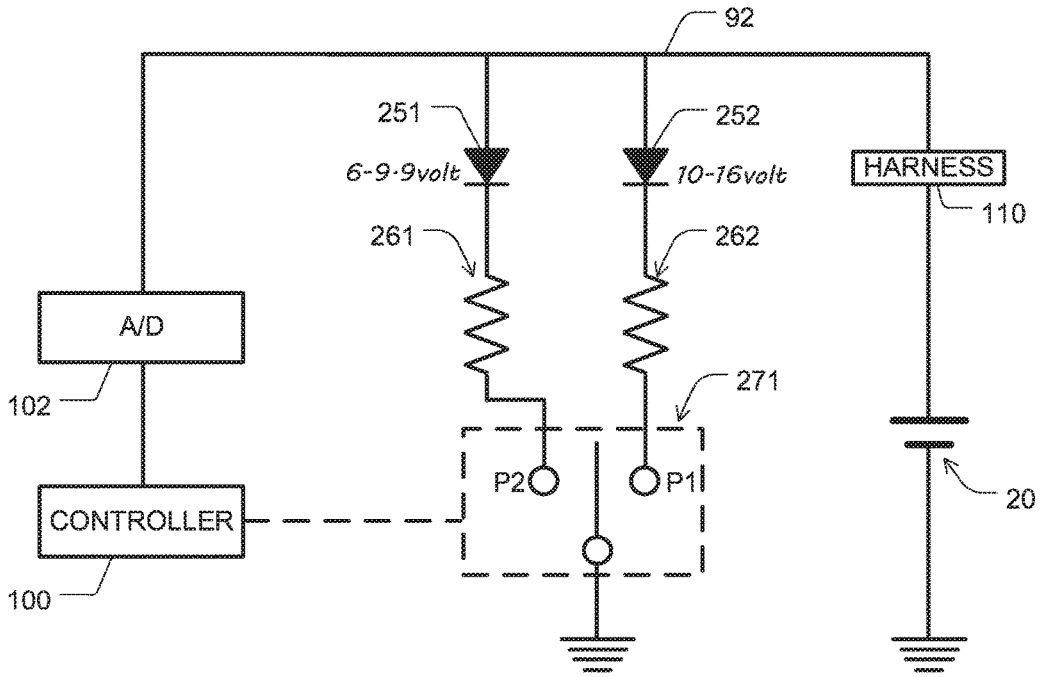
FIG. 7 is a diagram showing a circuit of an indicating device of a second embodiment.

As shown in FIG. 7, in the example, a first LED 251 may be connected with a resistor 261 in series, and a second LED 252 may be connected with a second resistor 262 in series. Both the first LED 251 and the first resistor 261 may be connected in parallel with both the second LED 252 and the second resistor 262. The first resistor 261 and the second resistor 262 may be connected with a switch 271 on the negative side. The first LED 251 and the second LED 252 may be connected with the power source 20 on the positive side.

In the example, the switch 271 may be a multiplexer to switch connection between a terminal P1 connected with the first LED 251 and a terminal P2 connected with the second LED 252. The switch 271 may be connected with the ground on the negative side. The switch 271 may disconnect the ground from both the first LED 251 and the second LED 252 to de-activate both the first LED 251 and the second LED 252. The switch 271 may be coupled with the controller 100 such that the controller 100 controls connection with either the first LED 251 or the second LED 252 or disconnection from both first LED 251 and the second LED 252.

An A/D converter 102 may be electrically connected between the positive side of the power source 20 and the controller 100. The A/D converter 102 may convert the power-line voltage of the power source 20 into a digital signal. The controller 100 may input the digital signal from the A/D converter 102 and may detect the power-line voltage of the power source 20.

In the present example, the arrangement of the first LED 251, the second LED 252, the screen 10, and the PCB 80 may be equivalent to that of the first embodiment shown in FIGS. 1 and 2.

In the present example, the power-line voltage may be assumed to vary in a power-line voltage range (full range) between 6 V and 16 V. It is noted that, the first LED 251 and the second LED 252 in the present example may have current-electricity characteristics, which are different from those of the first LED 51 and the second LED 52 in the first embodiment. In the present example, the first LED 251 and the second LED 252 may conduct electricity of 5 mA when applied with 6 V, may conduct electricity of 9.9 mA when applied with 9.9 V, may conduct electricity of 10 mA when applied with 10V, and may conduct electricity of 30 mA when applied with 16 V. Both the first LED 251 and the second LED 252 may have the same current-voltage characteristic.

In the example, dissimilarly to the first embodiment, the controller 100 may control the switch 271 to energize selectively one of the first LED 251 and the second LED 252 according to the detected power-line voltage. Specifically, when the controller 100 detects the power-line voltage within a lower power-line voltage range between 6 V and 9.9 V, the controller 100 may control the switch 271 to connect the first LED 251 with the ground to energize the first LED 251. To the contrary, when the controller 100 detects the power-line voltage within a higher power-line voltage range between 10 V and 16 V, the controller 100 may control the switch 271 to connect the second LED 252 with the ground to energize the second LED 252. That is, the first LED 251 may bear the lower half (lower portion: 6 V-9.9 V) of the full range (6 V-16 V) of the power-line voltage, and the second LED 252 may bear the higher half (higher portion: 10 V-16 V) of the full range. In the lower half of the full range, the first LED 251 may conduct electricity of 5 mA to 10 mA correspondingly to 6 V and 9.9 V. In the higher half of the full range, the second LED 252 may conduct electricity of 10 mA to 30 mA correspondingly to 10 V and 16 V.

Figure 8:
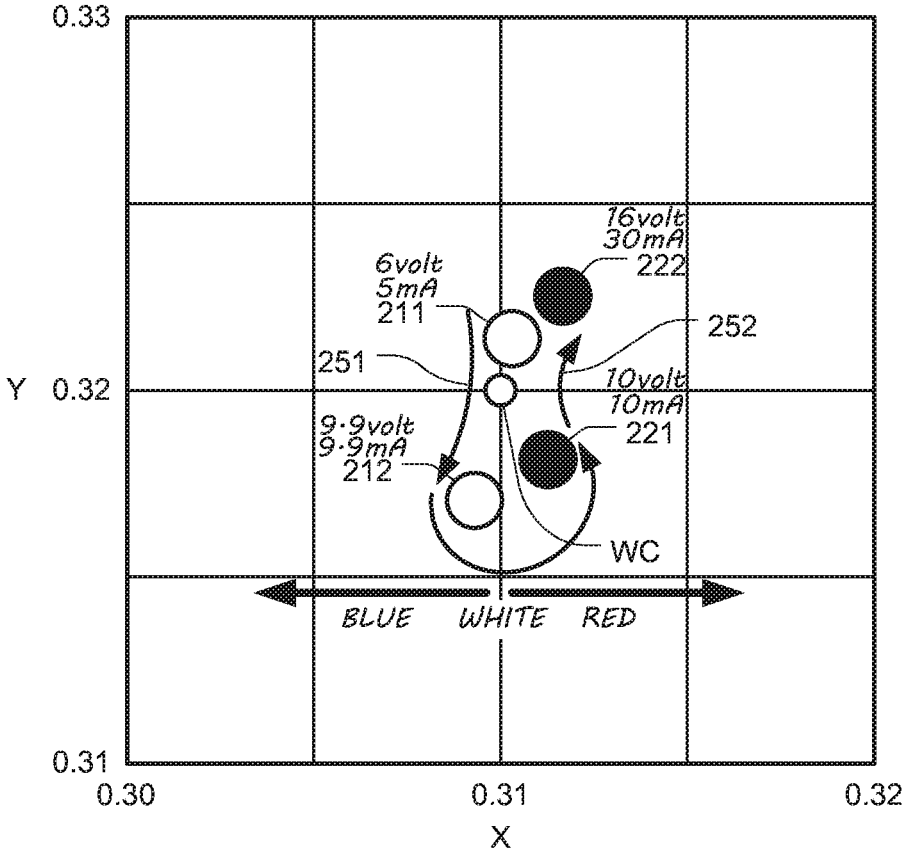
FIG. 8 is a graph showing a color characteristic of the second embodiment.

In FIG. 8, circles 211 and 212 may show the color characteristic of the first LED 251, and circles 221 and 222 may show the color characteristic of the second LED 252. The circles 211 and 212 may respectively correspond to an electric current of 5 mA and 9.9 mA in the first LED 251, and the circles 221 and 222 may respectively correspond to an electric current of 10 mA and 30 mA in the second LED 252.

In the lower power-line voltage range, the first LED 251 may be energized. As the electric current increases from 5 mA to 9.9 mA in the lower half corresponding to the lower power-line voltage range, the coordinates of the first LED 251 may move slightly leftward in the diagram along the solid arrow 251 through the white center WC.

When the power-line voltage increases from the 9.9 V to 10 V, the controller 100 may switch energization from the first LED 251 to the second LED 252. Thus, in the higher power-line voltage range, the second LED 252 may be energized. As the electric current increases from 10 mA to 30 mA in the higher power-line voltage range, the coordinates of the second LED 252 may move slightly rightward in the diagram along the solid arrow 252 to pass around the white center WC.

In the present example, the first LED 251 may bear the lower half of the full range of the power-line voltage, and therefore, the first LED 251 may cause a half color shift corresponding to the lower half. In addition, the second LED 252 may bear the higher half of the full range of the power-line voltage, and therefore, the second LED 252 may cause a half color shift corresponding to the higher half.

The half color shift caused in both the first LED 251 and the second LED 252 may be less than full color shift corresponding to the full range. Therefore, the present configuration may restrict the color shift within a narrow range, compared with a configuration causing full color shift.

Third Embodiment

Figure 9:
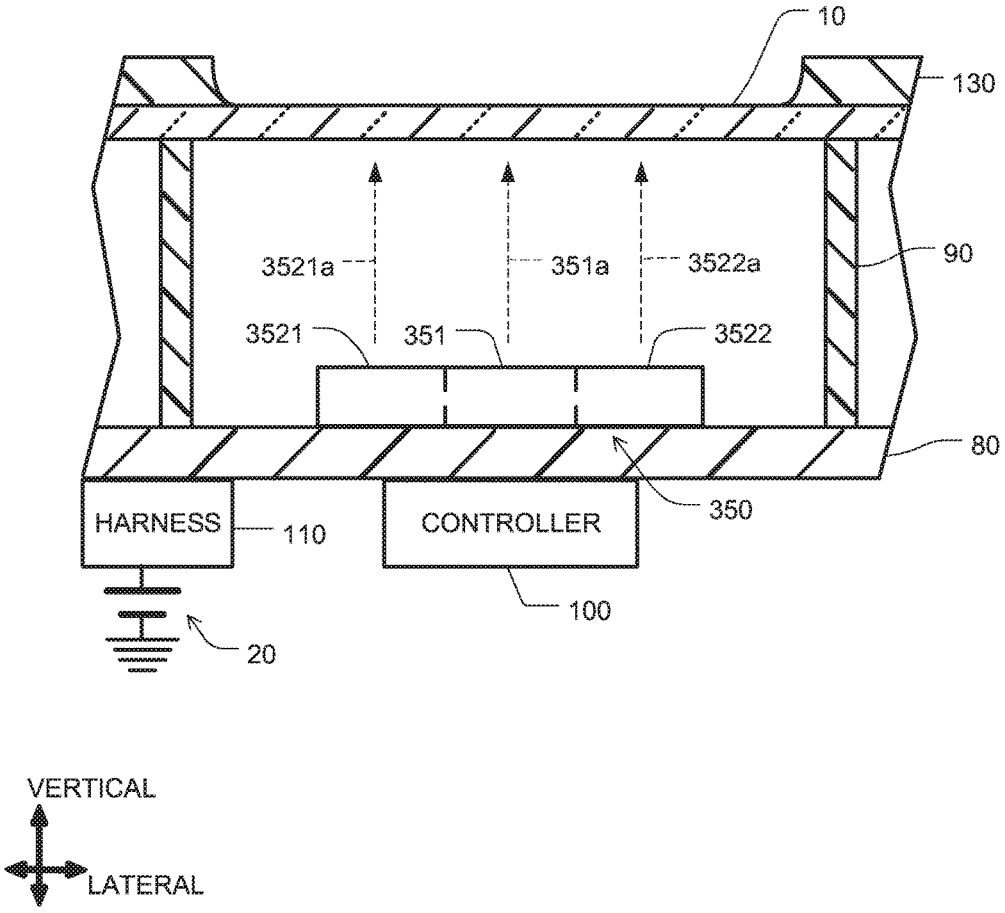
FIG. 9 is a sectional view showing an indicating device of a third embodiment.

As shown in FIG. 9, in the example, an LED device 350 may include a first LED 351, a lower second LED 3521, and a higher second LED 3522. The first LED 351, the lower second LED 3521, and the higher second LED 3522 may be integrated into one piece on a singular substrate and may be configured to emit lights individually.

Figure 11:
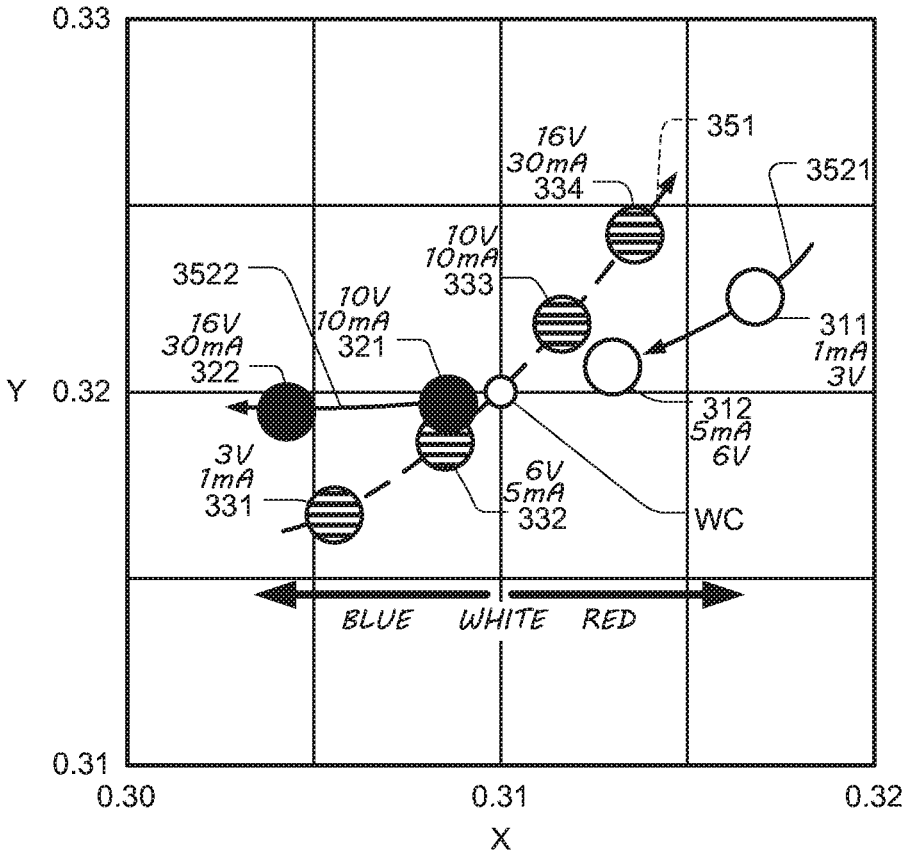
FIG. 11 is a graph showing a color characteristic of the third embodiment.

In FIG. 11, the first LED 351 may have a first color characteristic relative to increase in the power-line voltage. The first color characteristic of the first LED 351 may be similar to the first color characteristic described in the first embodiment. Specifically, the first LED 351 may increase intensity of red component in the emitted color by increasing the power-line voltage.

The lower second LED 3521 may have a lower part of a second color characteristic relative to increase in the power-line voltage. Specifically, the lower second LED 3521 may reduce intensity of red component in the emitted color toward the white center WC by increasing the power-line voltage. The higher second LED 3522 may have a higher part of the second color characteristic relative to increase in the power-line voltage. Specifically, the higher second LED 3522 may increase intensity of blue component in the emitted color from the white center WC by increasing the power-line voltage.

In FIG. 9, a first light 351*a* emitted from the first LED 351 and either of a lower second light 3521*a* emitted from the lower second LED 3521 or a higher second light 3522*a* emitted from the higher second LED 3522 may be mixed together and directed toward the screen 10.

Referring to FIG. 11, in the present example, the first LED 351 may conduct electricity of 1 mA when applied with 3 V, may conduct electricity of 5 mA when applied with 6 V, may conduct electricity of 10 mA when applied with 10V, and may conduct electricity of 30 mA when applied with 16 V. The lower second LED 3521 may conduct electricity of 1 mA when applied with 3 V, and may conduct electricity of 5 mA when applied with 6 V. The higher second LED 3522 may conduct electricity of 10 mA when applied with 10V, and may conduct electricity of 30 mA when applied with 16 V.

Figure 10:
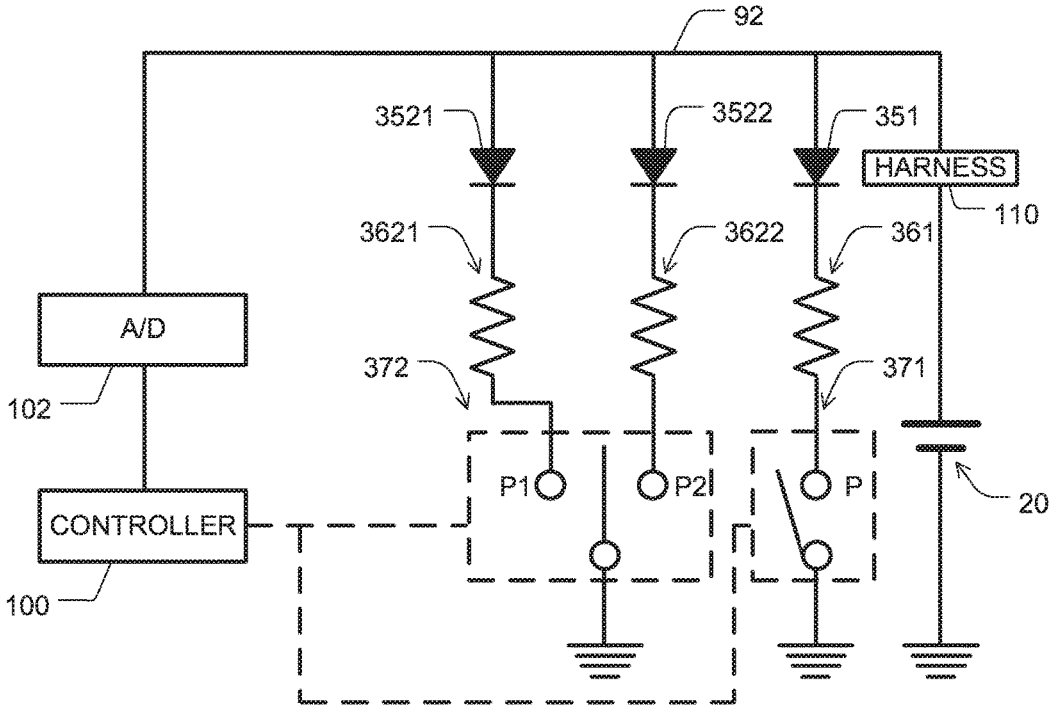
FIG. 10 is a diagram showing a circuit of the indicating device of the third embodiment.

In FIG. 10, the first LED 351 may be connected with a first resistor 361 and a first switch 371 in series. The first LED 351 may be connected with the power source 20 on the positive side. The first switch 371 may be connected with the ground on the negative side. The first switch 371 may be coupled with the controller 100 such that the controller 100 controls activation and deactivation of the first switch 371.

The lower second LED 3521 may be connected with a lower second resistor 3621 in series. The higher second LED 3522 may be connected with a higher second resistor 3622 in series. Both the lower second LED 3521 and the lower second resistor 3621 may be connected in parallel with both the higher second LED 3522 and the higher second resistor 3622. The lower second LED 3521 and the higher second LED 3522 may be connected with a second switch 372 on the negative side. The lower second LED 3521 and the higher second LED 3522 may be connected with the power source 20 on the positive side. The second switch 372 may be coupled with the controller 100 such that the controller 100 controls ON/OFF of the second switch 372. The controller 100 may control the second switch 372 to energize selectively one of the lower second LED 3521 and the higher second LED 3522 according to the power-line voltage. Specifically, when the controller 100 detects the power-line voltage within a lower power-line voltage range between 3V and 6V, the controller 100 may control the second switch 372 to connect the lower second LED 3521 with the ground to energize the lower second LED 3521. To the contrary, when the controller 100 detects the power-line voltage within a higher power-line voltage range between 10 V and 16 V, the controller 100 may control the second switch 372 to connect the higher second LED 3522 with the ground to energize the higher second LED 3522.

In FIG. 11, hatched circles 331, 332, 333, and 334 represent the first color characteristic. The circles 331, 332, 333, and 334 may respectively correspond to an electric current of 1 mA, 5 mA, 10 mA, and 30 mA supplied to the first LED 351. As the electric current increases, the coordinates of the first color may move rightward in the diagram along the dotted arrow 351 through the white center WC. That is, as the electricity of the first LED 351 increases, the first color being bluish at the circle 331 changes to whitish around the white center WC at the circles 332 and 333. Subsequently, the first color being whitish changes to reddish at the circle 334. Conversely, as the electricity decreases, the first color being reddish returns to bluish.

Blank circles 311 and 312 represent the lower second color characteristic. The circles 311 and 312 may respectively correspond to an electric current of 1 mA and 5 mA supplied to the lower second LED 3521. As the electric current increases, the coordinates of the lower second color may move leftward in the diagram along the solid arrow 3521. That is, as the electricity of the lower second LED 3521 increases, the lower second color being reddish at the circle 311 may change to whitish around the white center WC at the circle 312. Conversely, as the electricity decreases, the lower second color being whitish returns to reddish.

Solid circles 321 and 322 represent the higher second color characteristic. The circles 321 and 322 may respectively correspond to an electric current of 10 mA and 30 mA supplied to the higher second LED 3522. As the electric current increases, the coordinates of the higher second color may move leftward in the diagram along the solid arrow 3522. That is, as the electricity of the higher second LED 3522 increases, the higher second color being whitish around the white center WC at the circle 321 changes to bluish at the circle 322. Conversely, as the electricity decreases, the higher second color being bluish returns to whitish.

In FIG. 11, as represented by the circles 311 and 312, the lower second LED 3521 may be activated and may be reddish when the power-line voltage is between 3 V and 6V. As represented by the circles 331 and 332, the first LED 351 may be bluish when the power-line voltage is between 3 V and 6V. The circles 311 and 312 of the lower second LED 3521 are at opposite positions of the circles 331 and 332 of the first LED 351 across the white center WC thereby to produce complementary colors and to cancel (compensate) each other. As represented by the circles 321 and 322, the higher second LED 3522 may be activated and may be bluish when the power-line voltage is between 10 V and 16V. As represented by the circles 333 and 334, the first LED 352 may be reddish when the power-line voltage is between 10 V and 16V. The circles 321 and 322 of the higher second LED 3522 are at opposite positions of the circles 333 and 334 of the first LED 351 across the white center WC thereby to produce complementary colors and to cancel each other.

Fourth Embodiment

Figure 12:
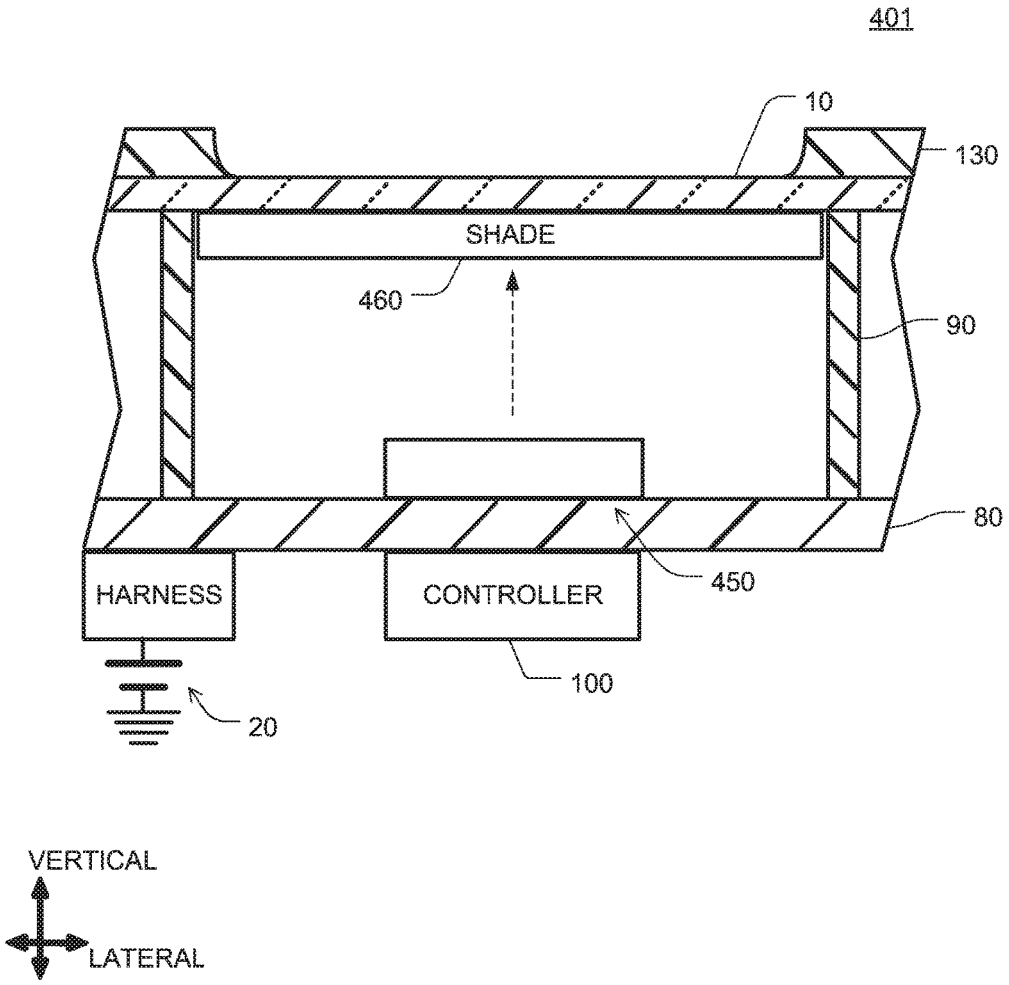
FIG. 12 is a sectional view showing an indicating device of a fourth embodiment.

As shown in FIG. 12, in the example, an indicating device 401 may include the screen 10, the printed circuit board (PCB) 80, the bezel 130, the partition 90, and the controller 100, which may be equivalent to those in the first embodiment. The indicating device 401 may further include a light emitting diode device (LED device) 450, and a shade device 460.

The LED device 450 may emit white light toward the screen 10 when being supplied with electricity. The LED device 50 may be a singular LED device being one piece formed on a singular substrate.

The shade device 460 may be a variable shutter, such as a liquid crystal display device, configured to control its transparency. The shade device 460 may be in a flat shape and may be located behind the screen 10. The shade device 460 may control transmission of light from the LED device 450 to the screen 10.

Figure 13:
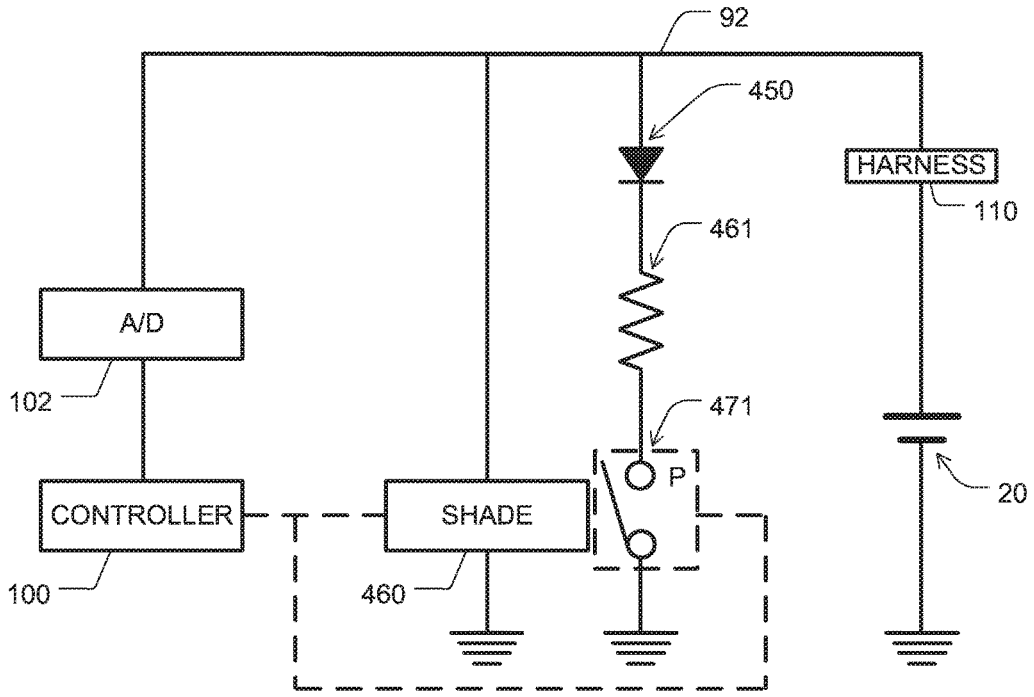
FIG. 13 is a diagram showing a circuit of the indicating device of the fourth embodiment.

As shown in FIG. 13, the LED device 450, a resistor 461, and a switch 471 may be connected in series. The LED device 450 may be connected with the power source 20 on the positive side. The switch 471 may be grounded on the negative side. The switch 471 may be coupled with the controller 100 such that the controller 100 controls activation and deactivation (ON/OFF) of the switch 471.

The shade device 460 may be connected with the power source 20 on the positive side and may be grounded on the negative side. The shade device 460 may be coupled with the controller 100 such that the controller 100 controls activation and deactivation of the shade device 460. For example, the controller 100 may increase voltage applied to the shade device 460 thereby to decrease transparency of the shade device 460. Alternatively, the controller 100 may decrease voltage applied to the shade device 460 thereby to increase transparency of the shade device 460.

The indicating device 401 may include the A/D converter 102. Similarly to the second embodiment, the controller 100 may input the digital signal from the A/D converter 102 and may detect the power-line voltage of the power source 20.

As the power-line voltage of the power source 20 increases, voltage applied to the LED device 450 and electric current passing through the LED device 450 may increase correspondingly. Therefore, the LED device 450 may increase intensity of light correspondingly. In response, the controller 100 may control the shade device 460 to decrease its transparency correspondingly to increase in the power-line voltage. Alternatively, the controller 100 may control the shade device 460 to increase transparency correspondingly to decrease in the power-line voltage. In this way, the controller 100 may control the shade device 460 adaptively to variation in the power-line voltage thereby to mitigate variation in intensity of light from the LED device 450. The controller 100 may store a data map storing a correspondence between the power-line voltage and a voltage applied to the shade device 460.

OTHER EMBODIMENT

The above embodiments may be partially or entirely combined arbitrarily.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An indicating device comprising:

a screen;

a first LED connected to a power line and configured to emit a first light in a first color toward the screen when applied with a power-line voltage of the power line; and, a second LED connected to the power line and configured to emit a second light in a second color toward the screen when applied with the power-line voltage, wherein the first color is complementary to the second color, and wherein when the power-line voltage is within a lower power-line voltage range between 3V and 6V, the controller controls a second switch to connect a lower second LED with the ground to energize the lower second LED and when the controller detects the power-line voltage within a higher power-line voltage range between 10 V and 16 V, the controller controls the second switch to connect a higher second LED with the ground to energize the higher second LED.

2. The indicating device of claim 1, wherein the first LED has a first color characteristic relative to increase in the power-line voltage, the second LED has a second color characteristic relative to increase in the power-line voltage, and the first color characteristic is opposite to the second color characteristic.

3. The indicating device of claim 1, wherein as the power-line voltage increases, the first LED is configured to increase a first color component in the first color, and the second LED is configured to increase a second color component in the second color, and the first color component and the second color component are complementary to each other.

4. The indicating device of claim 3, wherein as the power-line voltage decreases, the first LED is configured to decrease the first color component in the first color, and the second LED is configured to decrease the second color component in the second color.

5. The indicating device of claim 3, wherein the first color component is red, and the second color component is blue.

6. The indicating device of claim 1, wherein the first LED and the second LED are configured to emit the first light in the first color and the second light in the second color, respectively, to be mixed together to illuminate the screen.

7. The indicating device of claim 6, wherein the first light in the first color and the second light in the second color compensate each other to be whitish when mixed together.

8. The indicating device of claim 1, wherein the first LED and the second LED are connected to a common power line and a common ground line, and the first LED and the second LED are configured to be applied with a same voltage.

9. The indicating device of claim 1, further comprising:

a power source connected with the power line, wherein the power source is a battery for a vehicle.

10. The indicating device of claim 1, further comprising:

a switch configured to energize selectively one of the first LED and the second LED;

a controller configured to detect a power-line voltage of the power line and to control the switch to energize selectively one of the first LED and the second LED, wherein the controller is configured to cause the switch to energize the first LED and to de-energize the second LED when the power-line voltage is in a lower range, and the controller is configured to cause the switch to energize the second LED and to de-energize the first LED when the power-line voltage is in a higher range other than the lower range.

11. The indicating device of claim 10, wherein the lower range is a lower portion of a full range of variation in the power line voltage, and the higher range is a higher portion of the full range.

12. The indicating device of claim 1, wherein the second LED includes a lower second LED and a higher second LED, the indicating device further comprising:

a switch configured to energize selectively one of the lower second LED and the higher second LED;

a controller configured to detect a power-line voltage of the power line and to control the switch to energize selectively one of the lower second LED and the higher second LED, wherein the controller is configured to cause the switch to energize the lower second LED and to de-energize the higher second LED when the power-line voltage is in a lower range, and the controller is configured to cause the switch to energize the higher second LED and to de-energize the lower second LED when the power-line voltage is in a higher range other than the lower range.

13. The indicating device of claim 12, wherein the lower range is a lower portion of a full range of variation in the power line voltage, and the higher range is a higher portion of the full range.

* * * * *